US007480388B1

(12) United States Patent
Crook

(10) Patent No.: US 7,480,388 B1
(45) **Date of Patent: *Jan. 20, 2009**

(54) BEHIND THE EAR HEARING AID PART WITH EXCHANGEABLE COVER

(75) Inventor: Ben Crook, Berne (CH)

(73) Assignee: Bernafon AG, Berne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 12/187,270

(22) Filed: Aug. 6, 2008

Related U.S. Application Data

(63) Continuation of application No. 12/141,724, filed on Jun. 18, 2008.

(30) Foreign Application Priority Data

Aug. 7, 2007 (EP) ..... 07113963

(51) Int. Cl.
*H04R 25/00* (2006.01)

(52) U.S. Cl. ..... 381/322; 381/328

(58) Field of Classification Search ..... 381/312, 381/322, 328
See application file for complete search history.

(56) References Cited

U.S. PATENT DOCUMENTS

| | | | |
|---|---|---|---|
| 3,123,678 | A | 3/1964 | Prentiss et al. |
| 6,324,291 | B1 | 11/2001 | Weidner |
| 6,546,110 | B1 | 4/2003 | Vonlanthen |
| 6,625,290 | B1 | 9/2003 | Dittli |
| 2004/0196996 | A1 | 10/2004 | Feitel |
| 2006/0078141 | A1 | 4/2006 | Jessen et al. |
| 2006/0215863 | A1 | 9/2006 | Sauer |
| 2007/0053537 | A1 | 3/2007 | Wagner |
| 2007/0127757 | A2 | 6/2007 | Darbut et al. |
| 2007/0242845 | A1 | 10/2007 | Westermann |
| 2008/0002849 | A1 | 1/2008 | Tan |

FOREIGN PATENT DOCUMENTS

| | | | |
|---|---|---|---|
| DE | 9319114 | U | 4/1994 |
| EP | 0 453 200 | A2 | 10/1991 |
| GB | 2 305 067 | | 3/1997 |
| JP | 10-023599 | | 1/1998 |
| WO | WO-2005/034578 | | 4/2005 |
| WO | WO-2006/066570 | A1 | 6/2006 |
| WO | WO-2006/067133 | A1 | 6/2006 |
| WO | WO-2007/036228 | A1 | 4/2007 |

OTHER PUBLICATIONS

"Service Instruction, Oticon Delta 8000/6000/4000" Oticon, pp. 1-6 (2006)—Entire Document and Accelerated Examination Support Document.

Eisenberg, "The Hearing Aid as Fasion Statement," The New York Times, pp. 1-3 (2006).

"Sexy hearing aids targeted at ageing rockers", Financial Post, pp. 1-2 (2008).

"Vibe User Guide" Siemens, (2008).

"Widex Passion Accessories" Widex, (2008).

*Primary Examiner*—Brian Ensey
(74) *Attorney, Agent, or Firm*—Birch, Stewart, Kolasch and Birch, LLP

(57) ABSTRACT

The invention regards a BTE hearing aid shell shaped to fit behind an outer portion of an ear of a user wherein the shell has first and second opposed side walls where the first side wall faces away from, and the second side wall faces towards the head of the user. According to the invention an ornamental cover plate is detachably attached to at least one of the opposed side walls, and a release tool is provided for release of the cover plate.

5 Claims, 3 Drawing Sheets

BEHIND THE EAR HEARING AID PART WITH EXCHANGEABLE COVER

CROSS REFERENCE

This application is a Continuation of co-pending Application Ser. No. 12/141,724 filed on Jun. 18, 2008, the entire contents of which are hereby incorporated by reference and for which priority is claimed under 35 U.S.C. § 120; and this application claims priority of EP Application No. 07 113 963.8 filed in the European Patent Office on Jan. 24, 2008, respectfully, under 35 U.S.C. § 119, the entire contents of which are hereby incorporated by reference.

AREA OF THE INVENTION

The invention relates to behind the ear hearing aids (BTE hearing aids) and BTE hearing aid with receiver in the ear.

BACKGROUND OF THE INVENTION

For hearing aids of the above kind it is desired that the BTE part may be configured according to the users hair and skin colour and also it is desired, that the user of the hearing aid may style the colour according to dress and ornaments worn.

From U.S. 20040196996 A1 a cover for a BTE hearing aid is known where the cover includes a shell formed from a rigid material where the shell is adapted for a removable shaped fit over at least a portion of the BTE hearing aid. The cover disclosed in this document embraces the BTE part of the hearing aid from three sides which necessitates special provisions such as holes and the like in the cover for microphone inlets and components such as switches placed on the external side of the hearing aid.

From U.S. 20070127757 A2 hearing aid is disclosed, which has a shell shaped to fit behind an outer portion of an ear of a user. The shell has first and second sides that are substantially parallel to each other where the first side faces the outer portion of the ear, and the second side faces a head of the user. The behind-the-ear element also includes sound processing circuitry within the shell and an ear cushion switch operatively connected to the sound processing circuitry whereby the ear cushion switch is located on the first side of the shell.

A BTE hearing aid part which allows for simple fastening thereto and exchange of ornamental elements is thus desired.

SUMMARY OF THE INVENTION

According to the invention a BTE hearing aid shell shaped to fit behind an outer portion of an ear of a user wherein the shell has first and second opposed side walls where the first side wall faces away from, and the second side wall faces towards the head of the user whereby an ornamental cover plate is detachably attached to at least one of the opposed side walls. With such an attachment of an ornamental cover plate which may be detached from a side wall of the behind the ear part of a hearing aid it becomes very easy to change appearance of the hearing aid and the ornamental cover plate can be made very simple without provision for buttons, volume wheels and microphone inlets.

Preferably the ornamental cover plate is attached to the side wall by one or more compliant snap elements. Such compliant snap elements will ensure that the cover plate can easily be attached and detached from the side wall of the BTE part of the hearing aid.

In a further embodiment of the invention, the BTE hearing aid shell comprises a battery door hinged to the BTE hearing aid for pivotal movement between a closed position and an open position between the first and second opposed side walls and whereby an opening is provided in at least one side wall operative to be accessible from the outside when the battery door is pivoted to its open position. By providing such an opening in the side wall it becomes possible to apply pressure to the cover plate which will facilitate its release from attachment to the side wall. The provision of the opening inside the hearing aid in the region of the battery drawer and battery ensures that this opening remains invisible in ordinary use of the hearing aid.

Preferably at least two compliant snap elements are provided such that a compliant snap edge is provided on each side of the opening in the side wall, whereby pressure may be applied to the ornamental cover plate in a region between the two compliant snap edges for detaching the ornamental cover plate from the side wall. By allowing pressure to be applied in the region between two snap elements it becomes possible to use the flexibility of the cover plate in the release action thereof from the side wall. The cover plate will flex as a spring as a result of the applied pressure, and this flexing brings the snap elements out of engagement with their mating engagement parts of the side walls of the hearing aid.

In an embodiment of the invention a recess is provided in the side wall, which follows the outer contour of the ornamental cover plate in order to provide smooth transition from the surface parts of cover plate and side wall. This gives the hearing aid a nice and smooth surface which is interesting both for appearance and because it aids in keeping the apparatus clean.

The invention further comprises a tool for releasing an ornamental cover plate from a BTE hearing aid shell of the above kind, whereby the tool comprises a hand grip part and an opposed part with an implement, whereby the implement is insertable in a battery compartment of the hearing aid shell and whereby the implement part is smaller than an opening in the side wall, whereby the implement is operable to provide pressure on the back side of an ornamental cover plate for release thereof from the BTE hearing aid shell. Such a tool will allow pressure to be applied in a concentrated point through the opening in the side wall of the hearing aid.

DESCRIPTION OF A PREFERRED EMBODIMENT

Figure 1:
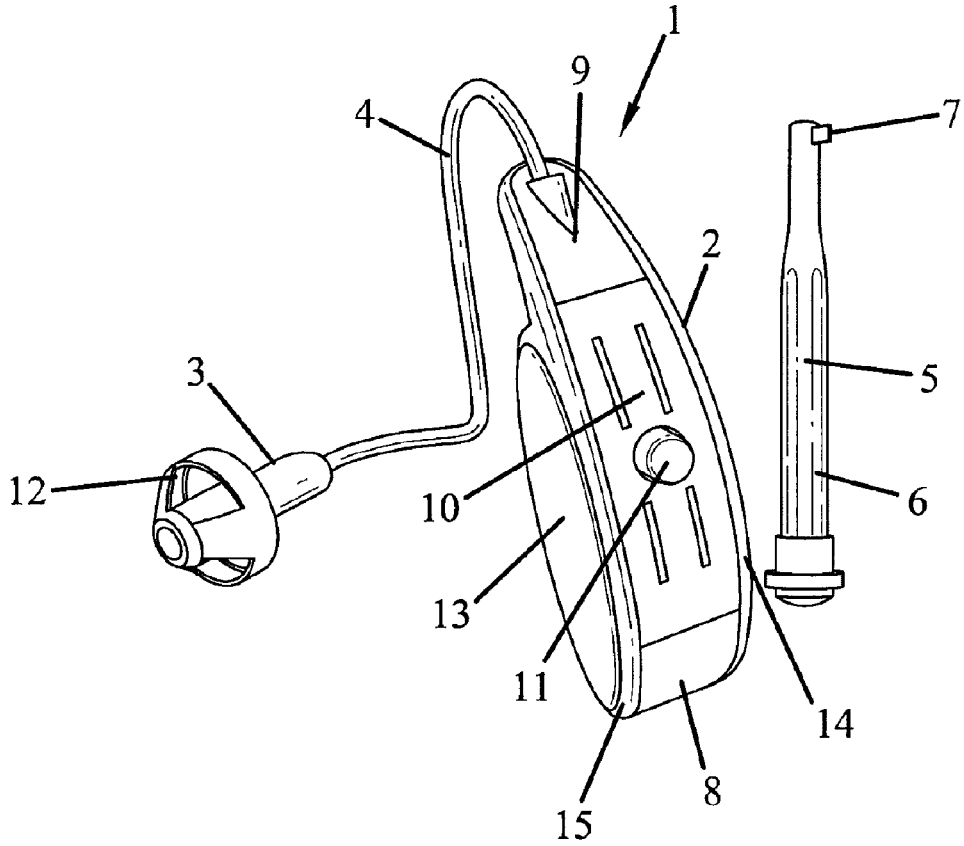
FIG. 1 is a perspective view of a BTE hearing aid according to the invention together with a tool for releasing the ornamental cover plate.

The hearing aid 1 in FIG. 1 comprises a behind the ear part (BTE part) 2 and an in the ear part (ITE part) 3. The ITE part 3 comprises a speaker and possibly a flexible dome or rigid custom made ear piece of sorts 12 for keeping the speaker in place. The BTE and ITE parts are interconnected by wires 4, such that an audio signal may be transferred from the BTE part to the speaker in the ITE part in order to produce an audio signal for the user.

Also in FIG. 1 a tool 5 is shown which has a shaft 6 and an implement 7 at the one end of the shaft 6. The tool 5 is to be gripped at the shaft 6, and manoeuvred to bring the implement 7 into contact with a specific part of the hearing aid 1 as described in more detail below.

The hearing aid 1 in FIG. 1 has a battery lid 8 provided opposed to a plug 9 for interconnection of the wires 4 to the BTE part 2. When the hearing aid 1 is placed behind the ear of a user the wires 4 will extend forwardly of the ear and into the ear canal and the battery lid 8 will lie behind the ear partially out of view from the front. A microphone cover plate 10 and a switch 11 are provided on an upper side of the BTE part 2 between the battery lid 8 and the plug 9. At two opposed sides 15, 14 ornamental cover plates 13 are provided and releasable attached to the BTE part 2.

Figure 2:
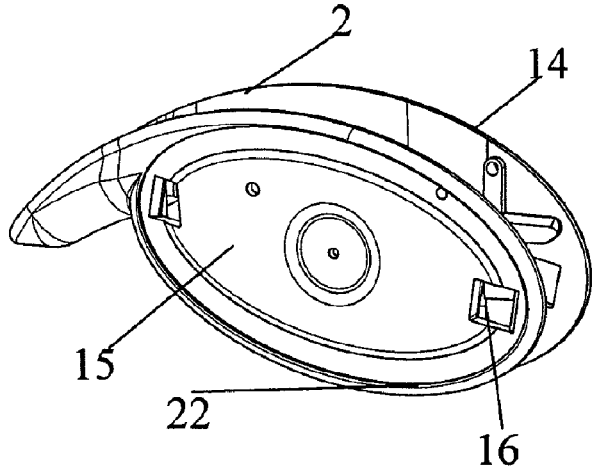
FIG. 2 is a perspective view of the base part of the hearing aid according to the invention without the ornamental cover plat, battery lid and microphone cover.
Figure 3:
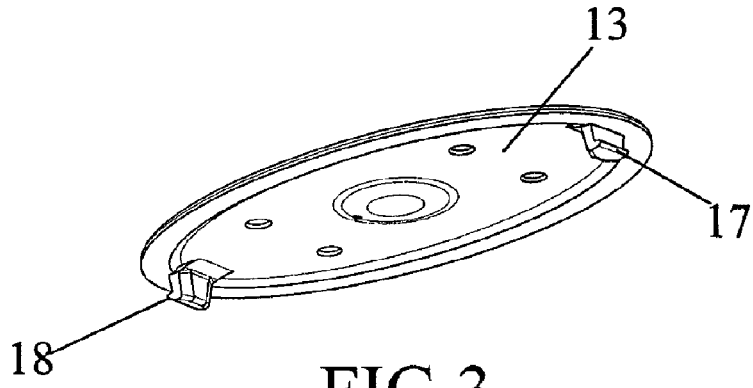
FIG. 3 shows the ornamental cover plate from the backside thereof in a 3D view.
Figure 4:
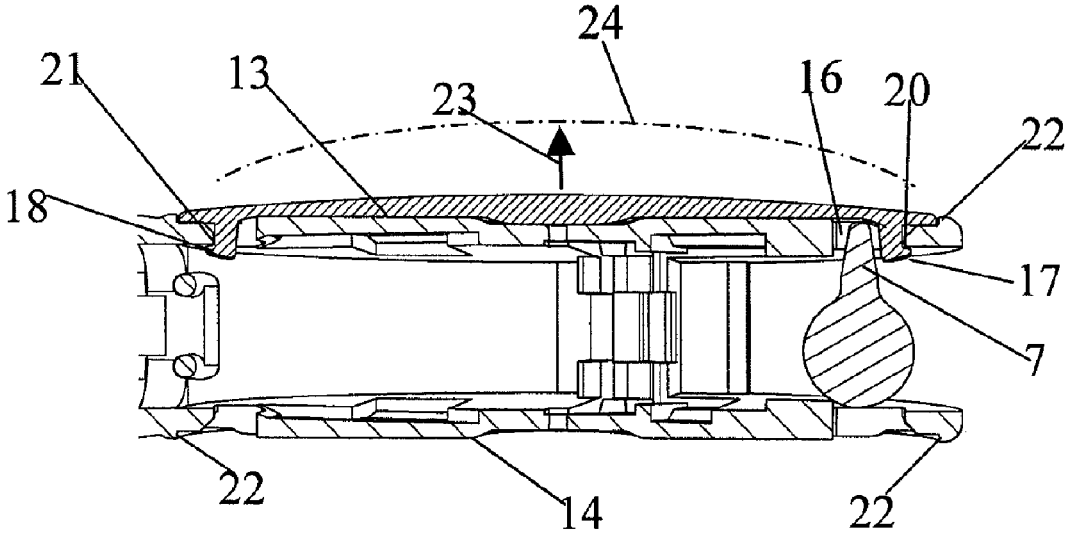
FIG. 4 shows a sectional view through the hearing aid with the tool inserted for removal of the ornamental cover plate.

In FIG. 2 the BTE part 2 is shown without the plug 9 and ITE part, the battery lid 8, the microphone cover plate 10, the switch 11 and the ornamental cover plate 13. In this view an opening 16 in side wall 15 is visible, and as shown in FIG. 4, the tool implement 7 may enter this opening through the battery lid 8 when the battery lid 8 is opened or removed. Through the opening 16 the implement 7 may exert pressure to the back side of ornamental cover plate 13 if the tool handle 6 is pivoted slightly when the implement 7 is positioned as shown in FIG. 4. The main advantage of this construction is that the ornamental cover plate 13 acts as a spring. The whole plate 13 can bend creating a spring effect. This spring effect is used to attach and detach the plates 13 to the side walls 14 and 15.

Figure 5:
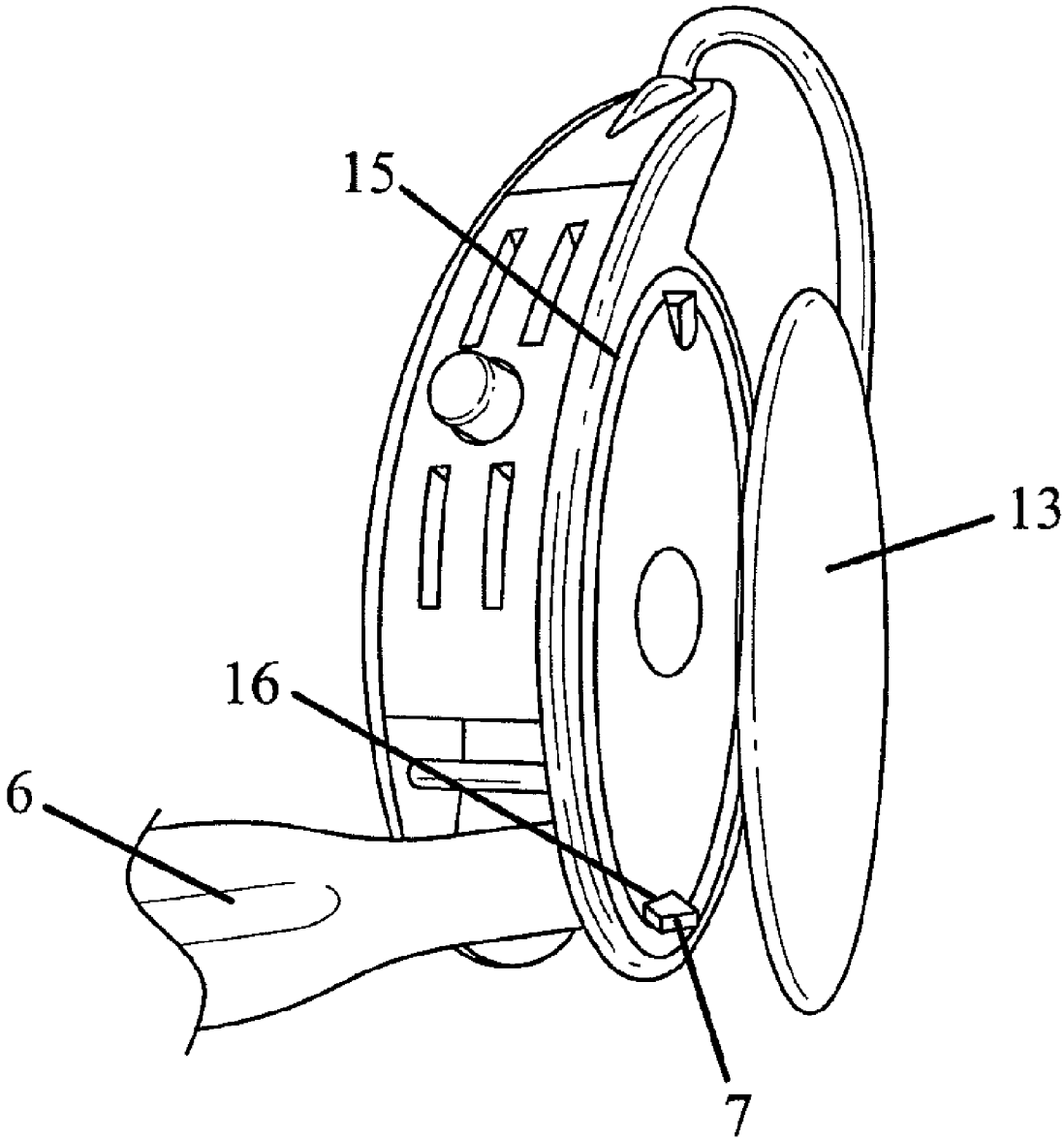
FIG. 5 is a 3D view of the hearing aid and tool right after release of the ornamental cover plate.

In FIG. 5 a better view of this action is provided: to remove the ornamental cover plate 13 the tool implement 7 is inserted, with the purpose to work as a lever, into the opening 16 from the inside of the battery compartment, and behind a compliant snap edge 17 of the ornamental cover plate 13. Holding the hearing instrument 2 between the fingers, the cover plate 13 may be gently pushed off the hearing aid housing. This action will generate a small click as the cover plate releases. This may be done for the opposed shell as well. As seen in FIG. 4 the cover plate 13 bends in the direction of arrow 23 to assume a curved shape schematically indicated by point and dash line 24 and this curvature facilitates the removal of the cover plate 13 from the side wall 15.

The snap edge 17 has a complementary engagement part 20 on the side wall 15 of the hearing aid. As seen in FIG. 4 the complementary engagement part 20 is provided adjacently to the opening 16. A further snap edge 18 is provided on the ornamental plate oppositely with regards to the battery end of the hearing aid, and also to this further snap edge 18 a complementary engagement part 21 is provided in side wall 15. The snap edges and complementary engagement parts may be provided in a number of different ways, but the disclosed configuration, where the snap edges are provided on protrusions which extends through openings in the side wall 15 such that the snap edges may gain a grip on the back side of the side wall 15 of the hearing aid has proven to work well. As seen in FIGS. 2 and 4 the side walls 14, 15 have a recess 22 which follows the contour of the ornamental cover plate 13, such that the visible surface parts of side walls 14, 15 will follow the contour of the surface of cover plate 13 when installed in the recess as shown in FIG. 4. Such a smooth transition between surface parts will aid to avoid dirt from accumulating in and around the transition area between cover plate 13 and side walls 15, 14.

As seen in FIG. 1 the cover plate 13, the battery lid and the microphone cover plate 10 are possibly provided in the same colour style, and as these elements are all easily exchangeable, the user or the hearing aid dispenser may change the appearance of the hearing aid by simply substituting these with differently coloured or decorated elements.

The invention claimed is:

1. BTE hearing aid shell shaped to fit behind an outer portion of an ear of a user wherein the shell has first and second opposed side walls where the first side wall faces away from, and the second side wall faces towards the head of the user whereby an ornamental cover plate is detachably attached to at least one of the opposed side walls by one or more compliant snap elements, wherein the BTE hearing aid shell comprises a battery door hinged to the BTE hearing aid for pivotal movement between a closed position and an open position between the first and second opposed side walls and whereby an opening is provided in at least one side wall for accessing an inner surface of the ornamental cover plate, said opening being accessible from the outside through the battery door when the battery door is pivoted to its open position.

2. BTE hearing aid shell as claimed in claim 1, wherein at least two compliant snap elements are provided such that a compliant snap edge is provided on each side of the opening in the side wall, whereby pressure may be applied to the ornamental cover plate in a region between the two compliant snap edges for detaching the ornamental cover plate from the side wall.

3. BTE hearing aid shell as claimed in claim 1, wherein a recess is provided in the side wall, which follows the outer contour of the ornamental cover plate.

4. BTE hearing aid shell as claimed in claim 1, wherein the ornamental cover plate extends along said one side wall and is separate from said one side wall.

5. BTE hearing aid shell as claimed in claim 1, wherein pressure may be applied to the ornamental cover plate at said opening for detaching the ornamental cover plate from the side wall.

* * * * *